United States Patent [19]

Waibel et al.

[11] 3,986,824

[45] Oct. 19, 1976

[54] PROCESS FOR THE MANUFACTURE OF A DYED SHEET-LIKE TEXTILE STRUCTURE

[75] Inventors: Heinz Waibel; Eckart Godau, both of Brembate sopra; Alfredo Buizza, Bergamo, all of Italy

[73] Assignee: Quikoton S.A., Glarus, Switzerland

[22] Filed: May 28, 1974

[21] Appl. No.: 473,715

[30] Foreign Application Priority Data

| | | |
|---|---|---|
| May 30, 1973 | Switzerland | 7833/73 |
| June 29, 1973 | Switzerland | 9527/73 |
| Nov. 16, 1973 | Switzerland | 16117/73 |
| May 8, 1974 | Switzerland | 6167/74 |

[52] U.S. Cl. ..... 8/14; 2/79; 8/16; 8/17; 8/149; 28/77

[51] Int. Cl.[2] ..... D06P 1/44; D06P 7/00

[58] Field of Search ..... 8/14, 16, 17, 149

[56] References Cited

UNITED STATES PATENTS

| | | | |
|---|---|---|---|
| 1,445,734 | 2/1923 | Warr | 8/14 |
| 2,103,587 | 12/1937 | Lantz et al. | 8/14 |
| 2,115,374 | 4/1938 | Wainwright et al. | 8/14 |
| 2,199,233 | 4/1940 | Williams | 8/14 |
| 2,823,092 | 2/1958 | Spencer | 8/14 |
| 3,102,771 | 9/1963 | Neale | 8/14 |
| 3,220,793 | 11/1965 | Parsons et al. | 8/14 |
| 3,669,611 | 6/1972 | Shimauchi et al. | 8/14 |

*Primary Examiner*—Ronald W. Griffin
*Attorney, Agent, or Firm*—Werner W. Kleeman

[57] ABSTRACT

A process for the manufacture of a uniformly dyed textile web intended for subsequent making-up into garments adapted to have a non-uniformly worn and faded appearance, those areas which are exposed to a greater degree of wear having a lighter color, which uses a pigment dyeing process having a binder to pigment ratio not exceeding about 5:1.

61 Claims, 1 Drawing Figure

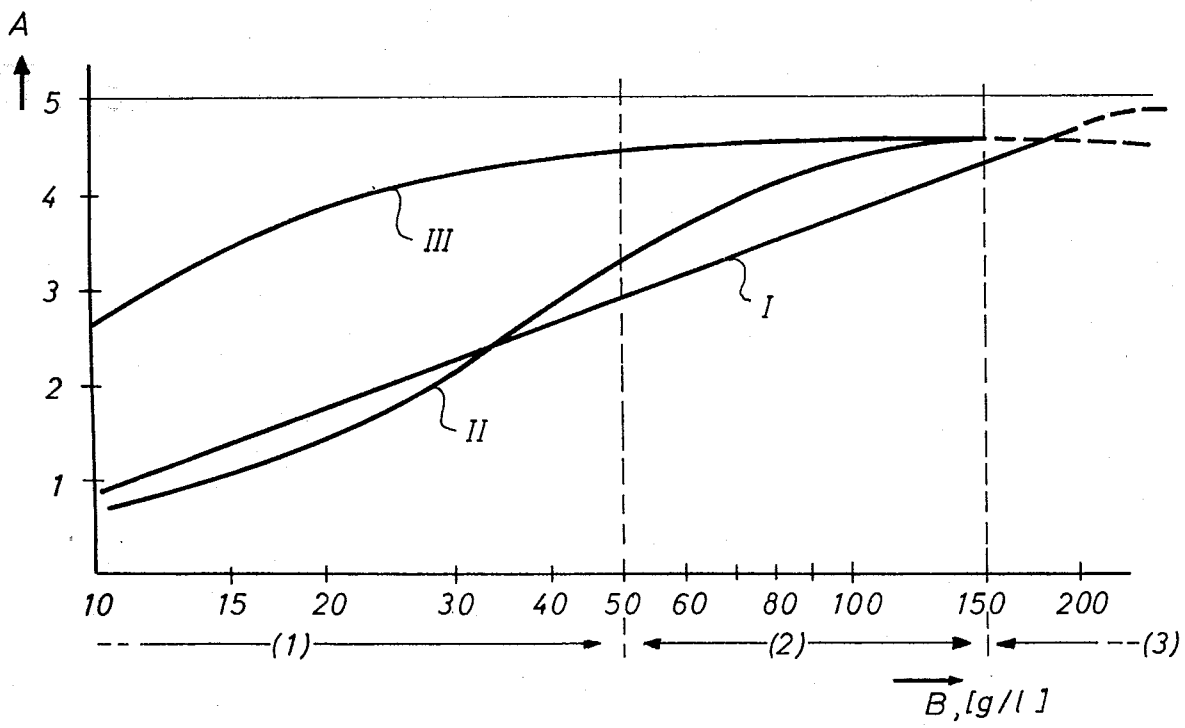
A
5
4
3
2
1
10
15
20
30
40
50
60
80
100
150
200
(1)
(2)
(3)
I
II
III
B, [g/l]

PROCESS FOR THE MANUFACTURE OF A DYED SHEET-LIKE TEXTILE STRUCTURE

The present invention relates to a new and improved process for the manufacture of a dyed sheet-like textile structure, intended for subsequent making-up or working into garments which have a worn and faded appearance even when new, with those areas which are more exposed to abrasion than the remainder of the garment, having a lighter colour.

Whilst, hitherto, the task of the textile industry, posed by the market, consisted almost always of supplying products which presented a faultless dyeing and appearance, more recently certain widespread fashion trends demand exactly the opposite: As compared with traditional ideas, garments should have an unsightly or even worn-out appearance without the expectation of a normal wearing quality being abandoned on that account. The result of this development has been that, for example, leisure trousers of the so-called "blue-jeans" type are already subjected by the manufacturer or vendor to special treatments which impart a faded uneven appearance to the dyeing. It is thus known from practice that cotton trousers dyed with sulphur dyestuffs can be washed with an addition of chlorine-containing products and uneven fadings can be achieved thereby. These and other artificial aging processes on a chemical basis are, however, not suitable for producing the characteristic features of worn-out leisure trousers. The wear and tear of blue jeans, caused by numerous wearing and washing cycles, is not characterised by cloudy discolourations, but rather by a selective lightening of the colour in exposed areas subject to rubbing, for example, along the edges and turn-ups resulting from making-up, at bagginess at knees and elbows, and at frayed edges which form in washing.

Another process already used in practice, which very readily produces these specific features of wear and tear, consists of subjecting the garments after making-up to numerous washing cycles, or carrying out a prolonged wash, for example in an automatic washing machine, until the desired degree of wear has been obtained. Such a procedure, however, is very expensive and time-consuming and, furthermore, results in an undesired impairment of the wearing quality.

Jeans goods have so far mainly been dyed by means of indigo dyeing. In this process, the goods are passed successively through several dye baths, in which the dyestuff is present in its leuco form or in a reduced dissolved form, and this leuco form is oxidised by an airing interposed between two successive baths. In this way, several dyestuffs layers are applied to the fibres.

In this process, no infuence can be exerted on the fastnesses of the dyeings. For example, the fastness to wet rubbing can be neither increased nor reduced.

In most cases, indigo dyestuffs or sulphur dyestuffs were used as the dyestuffs. However, dyeing with reactive dyestuffs or coupling dyestuffs, in particular the modern mixtures of naphthols and diazoamino compounds (for example, "Rapidogen," "Cibanogen," "Ronagen" and the like), is also possible. Here, it is also not possible to exert a substantial influence on the mechanical fastnesses of the dyeings.

Originally, the faded, worn-out appearance of the garments, desired by the consumer, could only be produced by the consumer himself carrying out numerous machine washes. Also, some garment manufacturers entrusted themselves to carrying out these repeated, numerous washes before selling, and also to abrading the overcast edges and seam edges of the garments, as described above. It is clear that the wear life of the article is considerably shortened by all these treatments; furthermore, this procedure is complicated and involved, expensive and economically and ecologically very objectionable because of the effluent load connected therewith and the wear of the material.

It was the task of the invention to provide dyed textile goods intended for the manufacture of the said textile articles, the textile goods being of such a nature that the garment made up therefrom in its new state, that is to say without a mechanical stress on the fibre, should have the desired worn-out appearance, without the necessity of numerous washing and also rubbing treatments before wearing it.

It was the first inventive idea, in a certain sense, to pretranspose the "wear out" of the garment potentially into the manufacture of the web goods.

The process according to the invention is now characterised in that 1. a textile material of the constituent fibres thereof are pretreated in such a way that the material has a uniform ground or base colour with good fastness to washing and rubbing over the entire cross-section;

2. the textile goods thus pretreated are provided with a surface colour by pigment dyeing or pigment printing, which weakened bonding of the pigment, in such a way that a. a colour difference arises between the ground colour and the surface colour, corresponding to stage 4 or lower of the international gray scale for color change (SNV 95.8.05) which is the swiss standard and which standard corresponds to the United States standard known as AATCC Evaluation Procedure 1, and b. the fastness to rubbing of the surface dyeing is at least one stage lower on the quoted gray scale than that of the ground colour, and 3. the dyed or printed textile material is subjected to a machine wash after fixing, in order to achieve good fastness to washing.

In the process according to the invention, the textile material can be employed in any desired form, for example, filament materials such as yarns, threads and other textile filament materials. These filaments can consist of natural, synthetic or semi-synthetic materials such as cellulose, regenerated cellulose, polyester, polyamid, polyacrylonitrile and the like and mixtures thereof.

Preferentially, however, the textile material used is a web-shaped sheet-like textile structure based on woven or knitted goods or fibre layers consolidatd by other techniques. Such web-shaped sheet-like textile structures are woven fabrics, knitted fabrics, knitting and fleeces.

In the case that filament materials are used as textile goods, the filaments are, after fixing the dyestuffs, further processed into a textile web by weaving, machine knitting, knitting or fleece consolidation. This can take place before or after the machine wash.

In this way, a textile web is economically obtained which, after making-up and certain optional after-treatments which are described further below, furnishes garments, for example leisure wear, which display the specific appearance of worn-out articles, in spite of being absolutely new.

The abovementioned rubbing fastness properties are to be understood as the wet fastness to rubbing.

The point of the invention is to distinguish between ground colour and surface colour. In fact, it was a further inventive idea to apply the outer dyeing in such a way that it is very predominantly located on the surface regions of the fibres, so that it is more easily abraded at the points of stress and then allows the ground colour to stand out, the fibres being optimally preserved. In the dyeing processes hitherto used for these articles, a certain penetration of the dyes into the fibres or yarns, at least 30% of the fibre or yarn diameter by order of magnitude, could not be avoided, because the known dyeing processes had, of course, been developed with a view to the best possible thorough dyeing of the fibres. Thus, the prolonged washing, hitherto carried out, and the optional surface grinding of the garments is always connected with a noticeable abrasion of the fibre.

The invention therefore provides a dyeing process based on pigment dyeing, which is in itself known, but it is substantially different from the latter.

It was known to dye or to print sheet-like textile structures with pigment dyestuffs. In this process, the pigments, which have no fibre affinity, must be fixed on the fabric by binders. The fabric is impregnated on a padder with a dispersion which essentially contains the binder (as an emulsion), the pigment (as a suspension) and a thickener (as a true or colloidal solution). In the subsequent drying and heat treatment, the dyestuff is fixed in that the binder, usually as a film, bonds the pigment particles to the fibre. In this case, it was known and customary to dye with only a low depth of shade, because a higher proportion of pigment also makes more binder necessary, and this leads to an unacceptable deterioration in the handle of the goods (compare Ullmanns Encyklopadie der techn. Chemie, [Ullmann's Encyclopedia of Industrial Chemistry], 3rd edition, volume 7, page 25).

For these reasons, pigment dyeing has not been able to find acceptance for deep-dyed garments such as jeans and the like.

The desired dyed textile material should, according to its purpose, be of such a nature that the fastness to rubbing of the surface dyeing is lower than that of the ground colour. However, overall a sufficient fastness to rubbing of the surface dyeing should remain. Finally, the surface colour must have good fastness to washing so that, when washed in service, a uniform brightening of the material does not occur which would no longer simulate a worn out appearance.

The aim of the invention thus was a dyeing with a relatively low fastness to rubbing, which can be accurately adjusted, and at the same time good fastness to washing.

A direct use of the known techniques of pigment dyeing, in which, according to the knowledge of those skilled in the art, the fastness to rubbing depends on the quantity and type of binder (compare Melliand Textilber. 5/1970, page 565–568), was not possible because it was known that the fastness to washing as well as the fastness to dry rubbing of pigment dyeings uniformly decrease with reduced amounts of binder (at the same dyestuff concentration). It was a strong presumption that the fastness to wet rubbing also decreases correspondingly.

Surprisingly, it has been found how the necessary "divergence" of the fastness to washing and fastness to rubbing, that is to say a relatively high fastness to washing connected with a relatively low fastness to rubbing, can be achieved, namely on the one hand, by weakening the bonding of the pigment and, on the other hand, by interposing a machine wash step after the dyeing or printing.

The dyeing or printing of textile filament materials with pigment dyestuff preparations was not known before the present invention.

The individual steps of the process will now be explained in more detail.

Examples of textile materials suitable for the process according to the invention are sheet-like textile structures such as the materials hitherto used particularly for leisure wear, generally in the form of webs based on woven or knitted goods or fibre layers consolidated by other techniques. These are twill, "denim," velvet, cord and other pile fabrics or non-wovens and also knitwear and other consolidated fibre layers of natural and artificial cellulose fibres, synthetic fibres such as polyester, polyamide and the like and mixtures of these fibres.

As stated above, textile materials can also be used in the form of filaments.

The uniform ground colour required can be incoporated into the fibre material before processing into filaments or into sheet-like textile structures, for example, in the case of synthetic fibres by an addition of coloured pigments to the spinning composition or by dyeing the fibre material by methods which are in themselves known, before or after spinning or texturising. The first step of the process, the production of a uniform ground colour over the entire cross-section of the textile material, is particularly simple to carry out if the natural colour of the undyed textile goods is chosen as the ground colour. It is then merely necessary to unify this colour by removing irregularly distributed foreign substances, such as pigment dirt, oily and fatty impurities or non-fast vegetable or animal dyestuffs, by washing, cleaning and optionally bleaching process which are in themselves known, in aqueous media or media containing solvents.

If the textile material is optically brightened or dyed in order to produce the ground colour, care must be taken in selecting the dyestuffs or the dyeing processes that a complete thorough dyeing with good fastness to washing and particularly to rubbing is achieved. The products or measures required for this are part of the stage of the art.

The textile goods now present in a uniform ground colour are then dyed by surface incorporation or deposition of the pigment dyestuff in such a way that, compared with the ground colour, a marked colour difference results, this colour contrast according to the invention corresponding to at least stage 4 of the international gray scale for color change for assessing the fastness properties of dyeings and prints, but preferably it should be greater, that is to say it should assume lower scale values. The application of the surface colour can take place over the entire surface, or, for example, by printing in a patterned form, different dyestuffs being applied side by side. The dyestuff used for the surface dyeing can be identical to or different from that of the ground colour. With identical dyestuffs, the surface colour must of course be deeper than the ground colour.

The process used for the production of the surface colour must, as mentioned, result in a relatively good fastness to washing, because with poor fastness to washing, the surface dyeing on the entire garment would rapidly become lighter due to bleeding, whereby the contrast with the ground colour would rapidly disappear everywhere. In this way, the purpose of the invention would not be achieved.

The extent of the fixing of the pigment dyestuff on the surface has to follow two criteria. On the one hand, as already mentioned, a relatively good fastness to the action of cold and hot cleaning liquors must be achieved, and on the other hand, the fastness to abrasion and rubbing must be markedly lower than that of the ground colour, so that the desired rubbing effect appears later on. One possibility of weakening the extent of fixing consists of using reduced amounts of binder, as compared with normal use, and another possibility consists of a weakened crosslinking of the binder by moderating the conditions of condensation in the thermofixing.

The weight ratios of binder to dyestuff normally used in pigment dyeing are, if the fabric is finished simultaneously, about 5:1 to 100:1 depending on the amount of dyestuff (compare the literature reference from Melliand Textilberichte, listed above). If the first possibility of weakening the degree of fixing is selected, weight ratios of binder to dyestuff are employed, according to the invention, which in general are below 1:1 and, for example, amount to about 0.6:1.

It is also possible to reduce the action of the binder by lowering the conditions of condensation in the thermofixing, that is to say the condensation is carried out at a lower temperature or/and for a shorter time. At present, however, the first-quoted possibility is preferred, that is to say less than equivalent amounts of binder are used in the operation.

The application of the dye liquor or the printing paste, which contains the pigment dyestuff, the binder (as a rule in less than the equivalent amount) and optionally a thickener as well as the additives normally to be used, takes place by padding or printing. Thereafter, the textile goods are treated, likewise in a known manner, for fixing the binder, that is to say they are heated.

A step of washing the dyed or printed textile goods now follows as the third process step. If a filament material has so far been used as the textile material, the washing step can also be carried out only after its further processing to a sheet-like textile structure. Excess dyestuff is thus removed and the fastness to washing of the textile goods is considerably improved without the (relatively low) fastness to wet rubbing being noticeably affected.

If a wash after fixing is omitted, a poor fastness to washing is observed in later washes of the garment made of such textile goods.

These circumstances are schematically reproduced in the drawing. This shows, for the following example with 36 g/l of Helizarin Black TT, the dependence in principle of the fastness to wet rubbing (curve I) in fastness ratings (A) on the ordinate versus the concentration of binder (B) (Helizarin binder F or FA) in g/l on the logarithmically subdivided abscissa. Curve II shows the fastness to washing, likewise in fastness ratings 1–5, of a dyeing which has not been post-washed and curve III shows that of textile goods treated according to the invention. The following areas are drawn in below the abscissa:

(1): Pigment dyeing with a less than equivalent amount of binder, according to the invention.

(2): Normal pigment dyeing for light shades.

(3): Pigment dyeing for deep shades, not recommended in the literature due to deterioration of the handle.

These limits drawn in can, of course, shift depending on the quality of binder. For example, a mixture of a "soft" and a "hard" binder can be employed. In order to weaken the bonding of the pigment, it is also possible to add an "antibinder," for example a dispersion of polyethylene, to the dye liquor.

If the textile goods are intended to show creases already lightened in the wash, the wash can be carried out on a rope washing machine. However, if the textile goods are not intended to show any outward traces of the finish according to the invention until they are made-up, an open-width washing machine or a jigger is preferred.

The wash can be carried out in a known manner, for example at approx. 60° C, with pure water or with the addition of surface-active materials.

A further additional possibility of an abrasion of dyestuff at certain places consist of inducing an embrittlement of the fibre parts which lie in the outermost layers of the textile goods, whereby dyestuff together with binder and fibre partices is ablated from the exposed edges in the abrasion step. This can, for example, be brought about by employing easily migrating resins which lead to embrittlement. The resins can be brought to the surface of the textile goods by transverse migration induced by drying.

The textile materials are finished, after the washing treatment, in the customary manner by finishing with components which impart a good handle or improve the easycare properties; this is carried out be a compressive shrink treatment, mechanical treatment of the surface and the like. These treatments can be carried out on the filament material or on the finished sheet-like textile structure, as described.

If the ablation of the surface dyeing by rubbing at the abrasion points is not left to the consumer, the made-up articles, in a packed form, can be subjected to an abrasion stress for the purpose of a partial rapid ablation of the surface dyeing in the area exposed to wear. In textiles with not too smooth a surface, their self-friction can be utilised for this purpose, for example, by moving the goods to be abraded in a rotary drum, optionally with periodic alternations of the sense of rotation. The duration of the treatment depends on the dimensions and the level of filling of the drum as well as on the desired extent of the ablation of colour. An increase in the intensity of abrasion can be achieved by lining the interior wall of the drum with abrasive coverings, for example, a fine abrasive cloth, by employing solid abrasive elements, for example ceramically bound silicon carbide, or by using mobile abrasive elements, for example in the form of spheres. The use of sand-blasing devices can also be suitable.

If importance is attached to the surface dyeing being not only abraded at the tendering crease produced by the packing and at the edges along seams and turn-over areas, resulting from making-up, but also at surface areas which, in wearing, become baggy at the knee, elbow and seat and are particularly stressed thereby, filling agents in the form of inflatable or filled elements are employed.

The removal of the abraded dye thus produced can be carried out pneumatically by blowing it out or by rinsing with water or liquors containing solvents. The garments can also be washed. These wet cleaning procedures can be combined with the abrasive treatment.

According to the process, a dyed sheet-like textile structure is obtained which in its appearance does not differ from normal textile material used for these purposes. Garments manufactured therefrom show, after the above aftertreatments or after short wearing, all the typical characteristics of a garment which has been worn for a long time and partially abraded, but the textile material itself has been abraded only very little or not at all and is thus not impaired in its wearing quality, but exists as new with a normal life expectation.

If the process according to the invention is applied to filament materials, the additional advantage of a simpler course of the process is obtained. Furthermore, the production of new colour effects becomes possible, if filaments are used which have been dyed differently or to a different depth, it also being possible for the ground colour to be different or of different depth. These colour effects can also be obtained in the form of a pattern. Moreover, yet other colour effects and pattern effects can be produced by the co-use of other undyed filaments, filaments which are fully dyed through or both. It is not necessary for the filaments optionally co-used to have been treated according to the invention.

Simpler stockholding and the possiblity of carrying out the process in plants which are not equipped for treating sheet-like structures, result as further advantages.

Most recently, fashion increasingly demands the so-called "grey look." This is to be understood as a textile material, for example cord or velvet, which has the appearance of a raw, unbleached and undyed fabric. Here too, materials and garments are preferred which give the impression of worn-out, washed-out articles.

According to the invention, this "grey look" is obtained on pile fabrics by applying, in step (2) of the process defined above, less than equivalent amounts of a pigment dyestuff preparation with a greige colour shade, to the pile side of a raw, unbleached pile fabric, in particular by means of the device described in Swiss Pat. Specification No, 535,074. This device for the continuous even application of regulated amounts of treatment liquors to a continuous textile material possesses a feed installation and a take-off installation for the textile material and at least one device for applying the liquor, and it is characterised in that the application device consists of a slop-pad roller which is located in a container for the treatment liquor in such a way that its axle is above the level of the treatment liquor, a stripper being pressed against the slop-pad roller and means being provided for driving the slop-pad roller at an adjustable speed and in either sense of rotation, that guide rollers, having mechanism or elements for adjusting their speed of rotation and their height, are provided which have the purpose of guiding the textile material over the slop-pad roller at a defined adjustable contact angle, outside the treatment liquor, and that at least one measuring device for measuring the weight per unit area and/or the liquid content of the textile goods is provided, one measuring device being located on the treated moist textile goods, to which the liquor has been applied, and being connected to a regulating unit which has the purpose of providing that a constant even amount is applied to the textile goods, by controlling the adjustable elements of the device.

Normally, the fabric guided over the application roller has a speed higher than the circumferential velocity of the application roller rotating in the same direction.

In the case of the textile material treated according to the invention, only the raised parts of the pile, for example the ridges of the cord in cord fabrics, are dyed, whilst the lower parts of the fabric and the reverse side of the fabric remain unchanged, that is to say they retain their original colour shade.

It has been found that garments of these fabrics with a "grey look" assume another colour shade when subsequently washed in liquors which contain optical brighteners. According to the invention, this colour change is avoided by already adding a relatively large amount of optical brightener to the pigment preparation, which is slop-padded upon the fabric, so that a possible later uptake of optical brightener by the fabric or garment can no longer cause a colour change.

The amount of pigment preparation applied is in general adjusted, depending on the desired effect and the dilution, to 15 to 65%, preferably to 20 to 25%, of the weight of the dry fabric.

Thereafter, step (3) of the above-defined process follows, that is to say the pigment dyeing is fixed and the fabric is subsequently washed and finished in the customary manner.

In comparison with untreated raw fabrics, which in the unwashed state possess the desired "grey look" but which lose their raw shade fairly rapidly on repeated washing with the customary household detergents and which assume a completely white colouration, "grey look" fabrics treated according to the invention - apart from the creases which have been subjected to abrasive stress - retain their raw beige shade for their entire lifetime.

In the further development of the present invention, it is possible to manufacture a sheet-like textile structure provided with a printed pattern which gives the impression of sewn-on patches.

A demand for garments of the type mentioned here has in fact resulted, in particular for trousers and jackets which not only look worn-out, but in addition are also covered with patches.

Of course, the manufacture of a garment with patches, the patches being individually put on, whether by sewing on or sticking on, is out of the question for large industrial production which alone can nowadays meet the high demand for clothing. Means were therefore sought for applying effects which give the simulated impression of sewn-on patches, already in the furnishing of sheet-like textile structures which are intended for the manufacture of the abovementioned clothing.

It has now been found that a patch pattern can be printed upon textile material, which has been obtained as above, washed and dried, and the prints obtained can be fixed, with a subsequent machine wash being carried out in the case of a pigment print with weakened bonding of the pigment, in order to increase the fastness to washing.

A sheet-like textile structure is thus employed to which a surface dyeing, which is very fast to washing, but not fast to wet rubbing, has been applied over a ground colour which is fast to washing and fast to rubbing. Details of the manufacture are mentioned in the above description.

In the patch printing according to the invention, which may be a single colour print or a multi-colour print, any known printing pastes can be employed. These printing pastes can contain one or more dyestuffs of the following series: Aniline black, basic dyestuffs, mordant dyestuffs, direct dyestuffs, disperse dyestuffs, indigosol dyestuffs, vat dyestuffs, metal complex dyestuffs, naphthol dyestuffs, developing dyestuffs, acid dyestuffs, sulphur dyestuffs and pigment dyestuffs. The selection in each case depends on the requirements of the market and on the printing process. At present, developing dyestuffs, naphthol dyestuffs and/or pigment dyestuffs are preferred. Furthermore, the printing paste also contains, in addition to the thickener which is always present, the customary, sometimes also necessary, auxiliaries such as mordants, printing oils, dyestuff binders, dyestuff solvents or dispersing agents, reducing agents, after-treatment agents and the like.

The patch print can be applied by any desired methods. Screenprinting is particularly advantageous. The printing can be carried out with or without repeat of pattern; in film printing, the repeat of pattern can also be interrupted.

The patches to be printed on are in general oblong or square. They can also have the shape of a trapezium or appear rhombic, oval, round and the like. A print of the type of a torn, irregularly shaped patch is also possible, which makes it even more true to nature. The minimum size of the patches in general is about 3 × 3 cm; their largest size should not exceed 30 cm in one direction.

The colour of the patches in general is different from that of the textile starting material. However, this is not mandotory, because with differing fastnesses of the dyeings of the starting material and the patches, the latter will be visually distinguished from the former as time goes on.

It is possible to apply by printing two or more patches with differing dyestuffs of the same or of another class, with differing colour shades and/or colour depths, differing mechanisms of fixing, differing fastnesses and differing forms and dimensions. Possibilities of extremely wide variation are here available; they can be selected depending on demand. All or part of the patches can be printed on by the process according to the invention, whereby they give the appearance of originating from a worn out garment. In the interest of being true to nature, the patches can also partially or wholly overlap; this is achieved by, for example, setting differing repeats of pattern in the separate printing of two patch patterns.

Seam stitches can also be printed on, for example in a white or yellow colour.

The printing of the patches upon the starting material can be carried out in the course of dyeing or printing the starting material, after the washing and drying of the latter. Sometimes, a period of storage will be interposed before printing, in particular if differing or differently dyed textile webs are to be provided with the same patch print.

The sheet-like textile structure printed with patches is finished off in the customary manner by finishing with components which impart a good handle or improved easycare properties; this is carried out be a compressive shrink treatment, mechanical treatment of the surface and the like. It is in principle also possible to carry out some or all such finishes before applying the patch print.

The following examples explain the invention in more detail.

EXAMPLE 1

A fine cord fabric of 100% cotton of the following construction:

| | Warp | Weft |
|---|---|---|
| Yarn gauge (English No.) | 20/1 | 14/1 |
| Fabric count (per cm) | 26 | 50 |

is bleached with $H_2O_2$, after cutting and the customary pretreatment (singeing, desizing and rinsing), and then has a uniform white ground colour.

The fabric is then padded on a padder with a liquor which contains 35 g/l of "Helizarin Black TT" (a pigment dyestuff of BASF) and 20 g/l of "Helizarin binder FA" (a binder for pigment dyestuffs of BASF), a squeeze effect of 80% being maintained. (In the normal fixing of a pigment, fast to rubbing, about 50 to 150 g/l of binder would be used for the same amount of dyestuff).

The material thus dyed is dried by passing it over a drying cylinder with a surface temperature of 140° C. Thereafter it is washed on a jigger, with a liquor which contains 1 g/l of "Cottoclarin KD" (Henkel) (4 passages at 60° C), thereafter it is twice rinsed cold and dried again on the cylinder. After final revivingemploying componets imparting a good handle, takes place in the customary manner.

The material is made up into jeans. After a single wash in a drum-type washing machine using the washing programme for lightly-soiled coloured material, during which the trousers are exposes to a wet abrasion stress, the trousers already appear as though they have already undergone numerous wearing and washing cycles.

EXAMPLE 2

A warn yarn intended for denim, consisting of 100% cotton of English number 20, is padded, before sizing, on a padder with a liquor which contains 35 g/l of "Helizarin Black TT" (a pigment dyestuff of BASF) and 20 g/l of "Helizarin binder FA" (a binder for pigment dyestuffs of BASF), the material being squeezed to a liquor uptake of 70 percent by a pair of rubber rollers. Thereafter, the warp, as a group of filaments, is let over heated cylinders and dried, whereupon it is sized in the customary manner.

The filament material thus dyed and sized is woven, using an undyed weft yarn No 14, into a material with a warp end count of 29 fillaments/cm and a pick count of 50 filaments/cm. Thereafter, the fabric is washed, rinsed, dried and after-treated as described in Example 1. Finally, it is made up into jeans.

These trousers are then abraded for 30 minutes in a rotary drier at normal temperature. The rotary drier is fitted with abrasive inserts and rotates at 50 revolutions per minute. Jeans with lightened areas along the seams and at creases are thus obtained.

EXAMPLE 3

A fine cord fabric of 100 percent cotton of the following construction:

| | Warp | Weft |
|---|---|---|
| Yarn gauge (English No.) | 20/1 | 14/1 |
| Fabric count (per cm) | 26 | 50 |

is cut up, desized, singed, scoured and dried, but not bleached.

On the machine described in Swiss Pat. Specification No. 535.074, the fabric is coated on the pile side with 20 to 25 percent, relative to the undyed dry fabric, of the following aqueous dyeing preparation: 5.6 g/l of Acramine Yellow FGRN (BAYER), 0.9 g/l of Acramine Red FB (BAYER), 1.2 g/l of Helizarine Black TT (BASF), 3.0 g/l of Blankophor BBU (Bayer) and 6 g/l of CRILAT DR 147 (acrylate binder of Montecatini, Milan). Thereafter the fabric is dried, for the purpose of fixing, in a tunnel drier at a surface temperature of 140° and finished, according to Example 1, by washing, rinsing and drying.

The material shows the beige shade of a cord from raw, unbleached fibre; it is made up into jeans. Even after a single wash in a drum-type machine using the washing programme for lightly-soiled coloured material, during which the trousers are exposed to a wet abrasion stress, the trousers appear as though they consist of raw, unbleached fibres and had already undergone numerous wearing and washing cycles.

EXAMPLE 4

A. A fine cord fabric of 100 percent cotton of the following construction:

| | Warp | Weft |
|---|---|---|
| Yarn gauge (English No.) | 20/1 | 14/1 |
| Fabric count per cm | 26 | 50 |

is, after cutting, singeing, desizing and washing-out, bleached with $H_2O_2$ and then has a uniform white ground colour.

The fabric is then padded on a padder with a liquor which contains 35 g/l of "Helizarin Black TT" (a pigment dyestuff of BASF) and 20 g/l of "Helizarin binder FA" (a soft pigment dyestuff binder of BASF, based on butyl acrylate) a squeeze effect of 80 percent being maintained. (In the normal fixing of a pigment fast to rubbing about 150 g/l of binder would be used for the same amount of dyestuff).

The material thus dyed is dried by a passage over a drying cylinder with a surface temperature of 140° C. The fabric, as a rope, is washed with pure water at a temperature of 60°–80° C. Thereafter the rope is opened up and the open-width goods are dried on a stenter frame.

B. The goods are then printed on a "Zimmer" type-screen printing machine, the repeat of pattern being 70 cm, with the following recipes:

COLOUR 1:

Patch 1, 15 × 7 cm; 40 g/kg of "Acramine Blue FBC", 5 g/kg of "Acramine Black FPV", 85 g/kg of "Acramine binder FLN," 15 g/kg of "Acrafix M" and 10 g/kg of ammonium biphosphate, made up to 1 kg with "Acrapon A". (Acramine Blue and Acramine Black are pigment dyestuffs of BAYER AG for pigment printing, oil-in-water. Acramine-binder FLN and Acrafix M are pigment binders for this system. Acrapon A is the appropriate emulsion thickener, a special benzine with water.)

COLOUR 2:

Patch 2, 8 × 8 cm; 18 g/kg of "Acramine Blue FBC," 5 g/kg of "Acramine Red FB," 2 g/kg of "Acramine Black FPV", 10 g/kg of "Acramine binder FLN," 10 g/kg of "Acrafix M" and 10 g/kg of ammonium biphosphate, made up to 1 kg with "Acrapon A". After drying, condensation is carried out for 5 minutes at 150° C. The fabric, in open width, is then washed with the liquor, which contains 1 g/l of a non-ionic detergent, at 50° C through 5 passages, rinsed cold and then dried on the cylinder. The final reviving is carried out in the customary manner, employing components which impart a good handle.

The material is made up into jeans. Even after a single wash in a drum-type washing machine using the washing programme for lightly soiled coloured material, during which the trousers are exposed to a wet abrasion stress, the trousers appear as through they had already undergond numerous wearing and washing cycles, and as though they were covered with new dark-blue patches and with the reddish-tinged dark blue patches of worn, creased garment.

EXAMPLE 5

A. A fabric is manufactured according to Example 4 part A, and is finished.

B. The goods are then printed on the machine according to Example 4 part B, using the following recipes:

COLOUR 1:

Patch 1, 15 × 7 cm; 35 g/kg of "Rapidogen Blue NB", 30 g/kg of urea, 50 g/kg of ethanol, 12 g/kg of 38° Be sodium hydroxide solution and 30 g/kg of "Rapidogen salt A," made up to 1 kg with thickener and water. ("Rapidogen Blue NB" is a developing dyestuff of BAYER AG. "Rapidogen salt A", monochloroacetate, is a development accelerator.)

COLOUR 2:

Patch 2, 8 × 8 cm; same recipe as in Example 4 part B, colour 2. After drying, condensation is carried out for 5 minutes at 150° and thereafter acid steaming takes place for 10 minutes. The fabric, in open width, is then washed with a liquor, which contains 1 g/l of non-ionic detergent, at 60° C through 5 passages, rinsed cold and then dried on the cylinder. The final reviving is carried out in the customary manner, employing components which impart a good handle.

The material is made up into jeans blouses. Even after a single wash in a drum type washing machine using the washing programme for lightly-soiled coloured material, during which the jacket is exposed to a wet abrasion stress, the jacket appears as though it had already undergond numerous wearing and washing cycles and as though it were covered with new blue patches and with the reddish-tinged dark blue patches of a worn creased garment.

EXAMPLE 6

A. A warp yarn of 100 percent cotton, English number 20, which is intended for denim, is padded, before sizing, on a padder with a liquor which contains 35 g/l of "Helizarin Black TT" (a pigment dyestuff of BASF)

and 20 g/l of "Helizarin binder FA" (a binder of BASF, for pigment dyestuffs), the material being squeezed to a liquor uptake of 70 percent by means of a pair of rubber rollers. Thereafter the warp is passed, as a bundle of filaments, over heated cylinders and dried, and the dyestuff is fixed for 5 minutes at 140–150° C. (For a normal fixing, fast to rubbing, approx. 150 g/l of pigment binder in the dyeing liquor would be necessary). Thereafter the yarn is washed, as a rope, with 1 g/l of "Cottoclarin KD" (a surface-active agent from HENKEL) at 60° C, using 4 passages, dried and sized.

The filament material is then woven with undyed weft yarn NE 14, to give a cord with a warp end count of 29/cm and a pick count of 50/cm.

B. The goods are then printed, according to the procedure of Example 4 part B and finished. Jeans made-up from these goods have the appearance and properties described in Example 4.

EXAMPLE 7

A dyed denim fabric is manufactured as described in Example 6, part A. It is printed according to the procedure of Example 5, part B, and finished.

Jeans made-up from the patched fabric have the appearance and properties described in Example 5.

EXAMPLE 8

A. A fabric is dyed according to Example 3 and finished.

B. The fabric is then printed with patch patterns, according to Example 4, part B, and finished. The material is made up into jeans. Even after a single wash in a drumtype washing machine using the washing programme for lightly soiled coloured material, during which the trousers are exposed to a wet abrasion stress, the trousers appear as though they consisted of raw, unbleached fibres and as though they had already undergone numerous wearing and washing cycles and were covered with dark blue patches and with reddish-tinged dark blue patches of a worn, creased garment.

EXAMPLE 9

This example illustrates the weakened bonding of the pigment under conditions which are insufficient to make the binder effective.

A fine cord fabric according to Example 1 is provided with an even white ground colour in accordance with the procedure indicated in Example 1.

The fabric is then padded on a padder with a liquor which contains 35 g/l of "Helizarin Black TT" (BASF), 100 g/l of "Helizarin binder FA" and 10 g/l of a polyethylene dispersion, a squeeze effect of 80 percent being maintained.

The material dyed in this way is then heated at 115–120° C for 5–7 minutes and is thereby dried. This brings about insufficient fixing of the binder.

Further treatment is carried out according to Example 1.

After making-up, trousers are obtained which in their appearance correspond to those of Example 1.

More recently it has become the fasion to provide jeans garments with badges, for example, coats of arms, flowers, labels, animal pictures and many others. These badges are in general stuck on, swen on or embroidered on.

The process according to the invention allows the overprinting of such badges, by simple appropriate modification of the printing pattern or patterns. In this connection, the expression "patch" in the present application should be understood as any discontinuous pattern printed on a sheet-like textile structure.

We claim:

1. A process for the manufacture of a uniformly dyed textile web selected from woven and non-woven fibrous materials intended for subsequent making-up into garments adapted to have a non-uniformly worn and faded appearance, those areas which are exposed to a greater degree of wear having a lighter color, comprising the steps of:

1. pretreating a textile web by at least one step selected from the group of cleaning, bleaching and fast dyeing which results in conferring to said textile web a uniform base color over the entire cross-section thereof and having good fastness to washing and abrasion;
2. applying to the surface of the thus pretreated textile web a pigment composition containing a pigment dyestuff and a binder, the binder to pigment ratio not exceeding about 5:1, said pigment dyestuff being selected as to shade and amount to confer to the surface of the pretreated textile web a surface color having a color difference, as compared with said base color, of stage 4 or lower of the international gray scle for color change, AATCC Evaluation Procedure 1;
3. thermofixing the pigment composition; and
4. subsequently subjecting the dyed textile web to an aqueous wash.

2. The process defined in claim 1, comprising the step of pretreating the textile web in step (1) by cleaning so that the uniform base color of the textile web is the natural color of said web.

3. The process defined in claim 1, comprising the step of pretreating the textile web in step (1) by cleaning and bleaching.

4. The process defined in claim 1, comprising the step of fast dyeing the textile web in step (1).

5. The process defined in claim 4, comprising the step of fast dyeing the textile web in step (1) by applying an optical brightening dyestuff to said textile web.

6. A process for the manufacture of a uniformly dyed textile web selected from woven and non-woven fibrous materials intended for subsequent making-up into garments adapted to have a non-uniformly worn and faded appearance and appearing to be covered with patches, comprising printing a patch pattern on the surface of the dyed textile web obtained by the process of claim 1.

7. The process defined in claim 6, including the step of applying the patch pattern by printing with a pigment printing paste, and fixing the pigment by heating.

8. The process defined in claim 6, including the step of applying the patch pattern by printing with a pigment printing paste containing a binder, the binder being present in an amount insufficient for an abrasion fast binding of the pigment, fixing the pigment by heating, and subjecting the printed and fixed textile web to a machine wash.

9. The process defined in claim 6, including the step of applying at least two patch prints which differ in their fastness properties.

10. The process defined in claim 6, including the step of applying at least two patch prints which differ in at least any one of color shade or color deepness.

11. The process defined in claim 10, wherein one print is carried out with developing dyestuffs and the other print with pigment dyestuffs.

12. The process defined in claim 1, for the manufacture of a fabric appearing as raw, unbleached pile fabric, wherein a raw, unbleached pile fabric is pretreated in step (1) by cleaning, an aqueous pigment preparation is applied in step (2) containing an optical brightener by means of a slop-pad roll to said pretreated pile fabric, said preparation being applied only to the pile surface of the fabric, said pretreated fabric being continuously passed over said slop-pad roll which rotates in a trough containing said aqueous pigment preparation in the same direction as the direction of movement of said fabric but with a lower circumferential speed than the travel speed of said fabric.

13. The process defined in claim 12, wherein from 15 to 65 percent of said pigment preparation is applied relative to the dry weight of the fabric.

14. The process defined in claim 13, wherein there is applied 20 to 25 percent of said pigment preparation.

15. A dyed textile web selected from woven and non-woven fibrous materials as obtained by the process of claim 1, comprising yarn which presents a uniform base color over its entire cross-section and as a surface color a pigment coloration differing in shade from said base color and having an abrasion fastness which is at least one stage lower on the international gray scale for color change, AATCC Evaluation Procedure 1, than the abrasion fastness of said base color.

16. A dyed textile web selected from woven and non-woven fibrous materials produced according to the process of claim 1 comprising yarn which present a uniform base color over its entire cross-section and as a surface color a pigment coloration differing in shade from said base color and having an abrasion fastness which is at least one stage lower on the international gray scale for color change, AATCC Evaluation Procedure 1, than the abrasion fastness of said base color, the textile web further presenting on its surface a patch pattern printed thereon.

17. The process defined in claim 1, wherein the binder to pigment ratio does not exceed about 1:1.

18. A process for the manufacture of a uniformly dyed textile web selected from woven and non-woven fibrous materials intended for subsequent making-up into garments adapted to have a non-uniformly worn and faded appearance, those areas which are exposed to a greater degree of wear having a lighter color, comprising the steps of:

1. pretreating textile yarn by at least one step selecting from the group of cleaning, bleaching, mass dyeing and fast dyeing which results in conferring to said textile yarn and uniform base color over the entire cross-section thereof and having good fastness to washing and abrasion;
2. applying to the surface of the thus pretreated yarn a pigment composition containing a pigment dyestuff and a binder, the binder to pigment ratio not exceeding about 5:1, said pigment dyestuff being selected as to shade and amount to confer to the surface of the pretreated textile yarn a surface color having a color difference, as compared with said base color, of stage 4 or lower of the international gray scale for color change, AATCC Evaluation Procedure 1;
3. thermofixing the pigment composition;
4. subsequently subjecting the dyed textile yarn to an aqueous wash; and
5. making-up the textile yarn into a textile web after any one of step (1), step (2), step (3) and step (4).

19. The process as defined in claim 18, comprising the step of pretreating the yarn in step (1) by cleaning so that the uniform base color of the textile yarn is the natural color of said yarn.

20. The process as defined in claim 18, comprising the step of pretreating the textile yarn in step (1) by cleaning and bleaching.

21. The process as defined in claim 18, comprising the step of fast dyeing the textile yarn in step (1).

22. The process as defined in claim 18, comprising the step of fast dyeing the textile yarn in step (1) by applying an optical brightening pigment dyestuff to said yarn.

23. The process defined in claim 18, including the step of using starting yarn which is mass dyed.

24. A process for the manufacture of a uniformly dyed textile web selected from woven and non-woven fibrous materials intended for subsequent making-up into garments adapted to have a non-uniformly worn and faded appearance and appearing to be covered with patches, comprising printing a patch pattern on the surface of the dyed textile web obtained by the process of claim 18.

25. The process defined in claim 24, including the step of applying the patch pattern by printing with a pigment printing paste, and fixing the pigment by heating.

26. The process defined in claim 24, including the step of applying the patch pattern by printing with a pigment printing paste containing a binder, the binder being present in an amount insufficient for an abrasion fast binding of the pigment, fixing the pigment by heating, and subjecting the printed and fixed textile web to a machine wash.

27. The process defined in claim 24, including the step of applying at least two patch prints which differ in their fastness properties.

28. The process defined in claim 24, including the step of applying at least two patch prints which differ in at least any one of color shade or color deepness.

29. The process defined in claim 28, wherein one print is carried out with developing dyestuffs and the other print with pigment dyestuffs.

30. A dyed textile web selected from woven and nonwoven fibrous materials produced according to the process of claim 18, comprising yarn which presents a uniform base color over its entire cross-section and as a surface color a pigment coloration differing in shade from said base color and having an abrasion fastness which is at least one stage lower on the international gray scale for color change, AATCC Evaluation Procedure 1, than the abrasion fastness of said base color, the textile web further presenting on its surface a patch pattern printed thereon.

31. The process defined in claim 18, wherein the binder to pigment ratio does not exceed about 1:1.

32. A process for the manufacture of a uniformly dyed textile web selected from woven and non-woven fibrous materials intended for subsequent making-up into garments adapted to have a non-uniformly worn and faded appearance, those areas which are exposed to a greater degree of wear having a lighter color, comprising the steps of:

1. pretreating a textile web by at least one step selected from the group of cleaning, bleaching and fast dyeing which results in conferring to said textile web a uniform base color over the entire cross-section thereof and having good fastness to washing and abrasion;
2. applying to the surface of the thus pretreated textile web a pigment composition containing a pigment dyestuff and a binder, said pigment dyestuff being selected as to shade and amount to confer to the surface of the pretreated textile web a surface color having a color difference, as compared with said base color, of stage 4 or lower of the international gray scale for color change, AATCC Evaluation Procedure 1;
3. partially thermofixing the pigment composition to produce an insufficient fixing of the pigment dyestuff and provide an abrasion fastness of the partially fixed pigment composition of at least one stage of the quoted gray scale lower than the abrasion fastness of said base color; and
4. subsequently subjecting the dyed textile web to an aqueous wash.

33. The process as defined in claim 32, comprising the step of pretreating the textile web in step (1) by cleaning so that the uniform base color of the textile web is the natural color of said web.

34. The process as defined in claim 32, comprising the step of pretreating the textile web in step (1) by cleaning and bleaching.

35. The process as defined in claim 32, comprising the step of fast dyeing the textile web in step (1).

36. The process as defined in claim 35, comprising the step of fast dyeing the textile web in step (1) by applying an optical brightening pigment dyestuff to said textile web.

37. A process for the manufacture of a uniformly dyed textile web selected from woven and non-woven fibrous materials intended for subsequent making-up into gaarments adapted to have a non-uniformly worn and faded appearance and appearing to be covered with patches, comprising printing a patch pattern on the surface of the dyed textile web obtained by the process of claim 32.

38. The process as defined in claim 37, including the step of applying the patch pattern by printing with a pigment printing paste, and fixing the pigment by heating.

39. The process as defined in claim 37, including the step of applying the patch pattern by printing with a pigment printing paste containing a binder, the binder being present in an amount insufficient for an abrasion fast binding of the pigment, fixing the pigment by heating, and subjecting the printed and fixed textile web to a machine wash.

40. The process as defined in claim 37, including the step of applying at least two patch prints which differ in their fastness properties.

41. The process as defined in claim 37, including the step of applying at least two patch prints which differ in at least any one of color shade or color deepness.

42. The process as defined in claim 41, wherein one print is carried out with developing dyestuffs and the other print with pigment dyestuffs.

43. A dyed textile web selected from woven and non-woven fibrous materials produced according to the process of claim 32, comprising yarn which presents a uniform base color over its entire cross-section and as a surface color a pigment coloration differing in shade from said base color and having an abrasion fastness which is at least one stage lower on the international gray scale for color change, AATCC Evaluation Procedure 1, than the abrasion fastness of said base color, the textile web further presenting on its surface a patch pattern printed thereon.

44. A process for the manufacture of a uniformly dyed textile web selected from woven and non-woven fibrous materials intended for subsequent making-up into garments adapted to have a non-uniformly worn and faded appearance, those areas which are exposed to a greater degree of wear having a lighter color, comprising the steps of :

1. pretreating textile yarn by at least one step selected from the group of cleaning, bleaching, mass dyeing and fast dyeing which results in conferring to said yarn a uniform base color over the entire cross-section thereof and having good fastness to washing and abrasion;
2. applying to the surface of the thus pretreated textile yarn a pigment compostion containing a pigment dyestuff and a binder, said pigment composition containing a pigment dyestuff and a binder, said pigment dyestuff being selected as to shade and amount to confer to the surface of the pretreated textile yarn a surface color having a color difference, as compared with said base color, of stage 4 or lower of the international gray scale for color change, AATCC Evaluation Procedure 1; 3. partially thermofixing the pigment composition to produce an insufficient fixing of the pigment dyestuff and provide an abrasion fastness of the fixed pigment composition of at least one stage of the quoted gray scale lower than the abrasion fastness of said base color;
4. subsequently subjecting the dyed textile yarn to an aqueous wash; and
5. making-up the textile yarn into a textile web after any one of step (1), step (2), step (3), and step (4).

45. The process as defined in claim 44, comprising the step of pretreating the textile yarn in step (1) by cleaning so that the uniform base color of the textile yarn is the natural color of said yarn.

46. The process as defined in claim 44, comprising the step of pretreating the textile yarn in step (1) by cleaning and bleaching.

47. The process as defined in claim 44, comprising the step of fast dyeing the textile yarn in step (1).

48. The process as defined in claim 44, comprising the step of fast dyeing the textile yarn in step (1) by applying an optical brightening pigment dyestuff to said textile yarn.

49. The process as defined in claim 44, including the step of using starting yarn which is mass dyed.

50. A process for the manufacture of a uniformly dyed textile web selected from woven and non-woven fibrous materials intended for subsequent making-up into garments adapted to have a non-uniformly worn and faded appearance and appearing to be covered with patches, comprising printing a patch pattern on the surface of the dyed textile web obtained by the process of claim 44.

51. The process as defined in claim 50, including the step of applying the patch pattern by printing with a pigment printing paste, and fixing the pigment by heating.

52. The process as defined in claim 50, including the step of applying the patch pattern by printing with a pigment printing paste containing a binder, the binder being present in an amount insufficeint for an abrasion fast binding of the pigment, fixing the pigment by heating, and subjecting the printed and fixed textile web to a machine wash.

53. The process as defined in claim 50, including the step of applying at least two patch prints which differ in their fastness properties.

54. The process as defined in claim 50, including the step of applying at least two patch prints which differ in at least any one of color shade or color deepness.

55. The process as defined in claim 54, wherein one print is carried out with developing dyestuffs and the other print with pigment dyestuffs.

56. A dyed textile web selected from woven and non-woven fibrous materials produced according to the process of claim 44, comprising yarns which presents a uniform base color over its entire cross-section and as a surface color a pigment coloration differing in shade from said base color and having an abrasion fastness which is at least one stage lower on the international gray scale for color change, AATCC Evaluation Procedure 1, than the abrasion fastness of said base color, the textile web further presenting on its surface a patch pattern printed thereon.

57. The dyed textile web according to claim 56, wherein the same is a twill.

58. The dyed textile web according to claim 56, wherein the same is a denim.

59. The dyed textile web according to claim 56, wherein the same is a pile fabric.

60. The dyed textile web according to claim 59, wherein the pile fabric is a velvet.

61. The dyed textile web according to claim 59, wherein the pile fabric is a cord.

* * * * *